US005319865A

United States Patent [19]

Jaeggi

[11] Patent Number: 5,319,865

[45] Date of Patent: Jun. 14, 1994

[54] APPARATUS FOR DRAINING OF YARN BOBBINS

[75] Inventor: Markus Jaeggi, Wattwil, Switzerland

[73] Assignee: Rhone-Poulenc Viscosuisse S.A., Emmenbruecke, Switzerland

[21] Appl. No.: 26,512

[22] Filed: Mar. 4, 1993

Related U.S. Application Data

[63] Continuation-in-part of Ser. No. 675,902, Jun. 10, 1991, abandoned.

[30] Foreign Application Priority Data

Sep. 13, 1989 [CH] Switzerland ..... 3336/89

[51] Int. Cl.[5] ..... F26B 13/30

[52] U.S. Cl. ..... 34/92; 34/104

[58] Field of Search ..... 34/104, 15, 92, 20, 34/21, 77, 23

[56] References Cited

U.S. PATENT DOCUMENTS 1,629,167 5/1927 Krantz ..... 34/104

4,075,765 2/1978 Karrer et al. ..... 34/104

OTHER PUBLICATIONS

Cassell's German and English Dictonary by Karl Breul, Cassell and Co., London, p. 172.

Technology of Textile Properties, M. A. Taylor, A.T.I., p. 8.

*Primary Examiner*—Henry A. Bennet

*Attorney, Agent, or Firm*—Michael J. Striker

[57] ABSTRACT

The apparatus for draining dyed yarn on yarn bobbins includes a vacuum pump; a hollow dye carrier insert for carrying a plurality of yarn bobbins having yarn to be drained thereon, an interior volume of this dye carrier insert being connectable to the vacuum pump and structured so that, when at least a partial vacuum is produced in the interior volume by the vacuum pump, air is drawn through the yarn on the bobbins into the interior volume; a vacuum tank connected to the vacuum pump for producing a vacuum as ballast and having a capacity not less than the interior volume of the dye carrier insert; a coupling device for receiving the dye carrier insert on which the yarn bobbins are mounted; a bell releasably mountable on the coupling device to enclose the dye carrier insert carrying the yarn bobbins in a vacuum-tight manner and a connecting pipe with a valve connecting the coupling device to the vacuum tank and operable so as to be able to form the partial vacuum in the dye carrier insert for draining the yarn carried on the yarn bobbins. No centrifuge for the yarn spools and no rotation devices for the dye carrier insert and the yarn bobbins are necessary to remove water from and drain the yarn resulting in a more economically operated apparatus.

4 Claims, 3 Drawing Sheets

APPARATUS FOR DRAINING OF YARN BOBBINS

The present application is a continuation-in-part of U.S. patent application Ser. No.: 07/675,902, filed Jun. 10, 1991, now abandoned.

BACKGROUND OF THE INVENTION

The present invention relates to an apparatus for draining yarn on a dye carrier insert, which yarn was dyed and carried on yarn spools bobbins held on the dye carrier insert.

Bobbin-dyed yarn must be drained after dyeing. The dyeing is conventionally performed in a dyeing apparatus in which dye carrier inserts are mounted. The dye carrier insert holds a plurality of yarn bobbins carrying the yarn mounted one above the other. For the purpose of drying, the yarn bobbins are taken out of the dyeing apparatus and inserted into a centrifuge on the dye carrier.

This draining apparatus for draining bobbin-dyed yarn is known from JP-A-59-137559. This draining apparatus comprises a centrifuge whose outlet is connected to a vacuum pump via a vacuum tank as buffer. Moreover, a mechanism is provided for circulating air.

Although this centrifuge apparatus drains the yarn in a satisfactory manner, it has several considerable disadvantages. For example, the yarn bobbins located in the center of the centrifuge are not drained as well as those arranged on the periphery of the centrifuge. The time required for loading the centrifuge with individual yarn bobbins is comparatively long and the energy consumed by the centrifuge in operation is comparatively large. The centrifuge must be of a special type and must be designed for receiving bobbin carriers.

SUMMARY OF THE INVENTION

It is an object of the present invention to provide a draining apparatus for dyed textured yarn which provides a more economical draining without moving parts and with less labor than the draining apparatus of the prior art.

According to the present invention, the apparatus for draining dyed yarn on yarn spools comprises means for producing a vacuum; a hollow dye carrier insert having an interior volume and means for carrying a plurality of yarn spools having yarn to be drained wound thereon, the means for carrying being connected to the means for producing a vacuum and structured so that, when at least a partial vacuum is produced in the interior volume by the means for producing a vacuum, air is drawn through the yarn on the bobbins into the interior volume; vacuum tank means connected to the means for producing a vacuum as ballast, the vacuum tank means including a vacuum tank having a capacity not less than the interior volume of the dye carrier insert; coupling means for receiving the dye carrier insert on which the yarn bobbins are mounted; a bell releasably mountable on the coupling means to enclose the dye carrier insert carrying the yarn bobbins in a vacuum-tight manner and valve means connecting the coupling means to the vacuum tank means and operable so as to be able to form the at least partial vacuum in the interior volume of the dye carrier insert for draining the yarn carried on the yarn bobbins. No centrifuge means for the yarn bobbins and no means for rotation of the dye carrier insert and the yarn bobbins to remove water from or drain moisture from the yarn on the yarn bobbins are provided.

The apparatus according to the invention has the advantage that no parts which are rotatably driven are used in it, except for those parts which might be rotatably driven in the means for producing the vacuum. This draining apparatus is considerably simpler than the prior art device, consumes less energy and is loaded more rapidly.

Furthermore no special yarn bobbin carriers are required in the apparatus according to the invention.

It is advisable to connect the coupling means with a vacuum tank whose capacity is greater than the volume of the dye carrier insert. This has the advantage that a very rapid draining of the yarn held on the yarn bobbins can be performed. The degree of draining can be controlled according to the completeness of the vacuum in the vacuum tank means.

In a preferred embodiment of the invention the coupling means has a central coupling tube and the dye carrier insert has a central pipe opening into its interior volume. This central coupling tube is releasably connectable in a vacuum tight manner with the central pipe and the diameters of the two pipes are approximately equal. The pipe connector means for releasably connecting the central pipe and the central coupling tube can be any of a variety of conventional pipe couplers used to couple pipes and/or tubes in a leak tight manner. The coupling process is thus made more precise and easier. A connecting pipe can also be provided connecting the central coupling tube of the coupling means in a vacuum-tight manner with the vacuum tank. The valve means can be located in the connecting pipe.

The coupling means can also include a trough for collecting dripping water from the yarn bobbins. The trough can be provided with drain means for discharge of the collected water.

The bell can be provided with a inlet connector having another valve means for admitting air to the bell after the drying has been completed so that the bell can be removed or for admitting a mixture for treating the yarn.

The means for carrying the yarn bobbins of the dye carrier insert advantageously comprises a plurality of perforated carrier tubes mounted on a hollow base. Each of the carrier tubes is closed at an upper end advantageously by a threaded rod for securing a yarn bobbin cover and opens at a lower end into the hollow base. Furthermore the open end of the carrier tube communicates with the central pipe so that air and moisture can be drawn through the perforations of the carrier tube and through the central pipe into the vacuum tank means via the coupling means.

BRIEF DESCRIPTION OF THE DRAWING

The objects, features and advantages of the present invention will now be illustrated in more detail by the following detailed description, reference being made to the accompanying drawing in which.

DETAILED DESCRIPTION OF THE INVENTION

Figure 1:
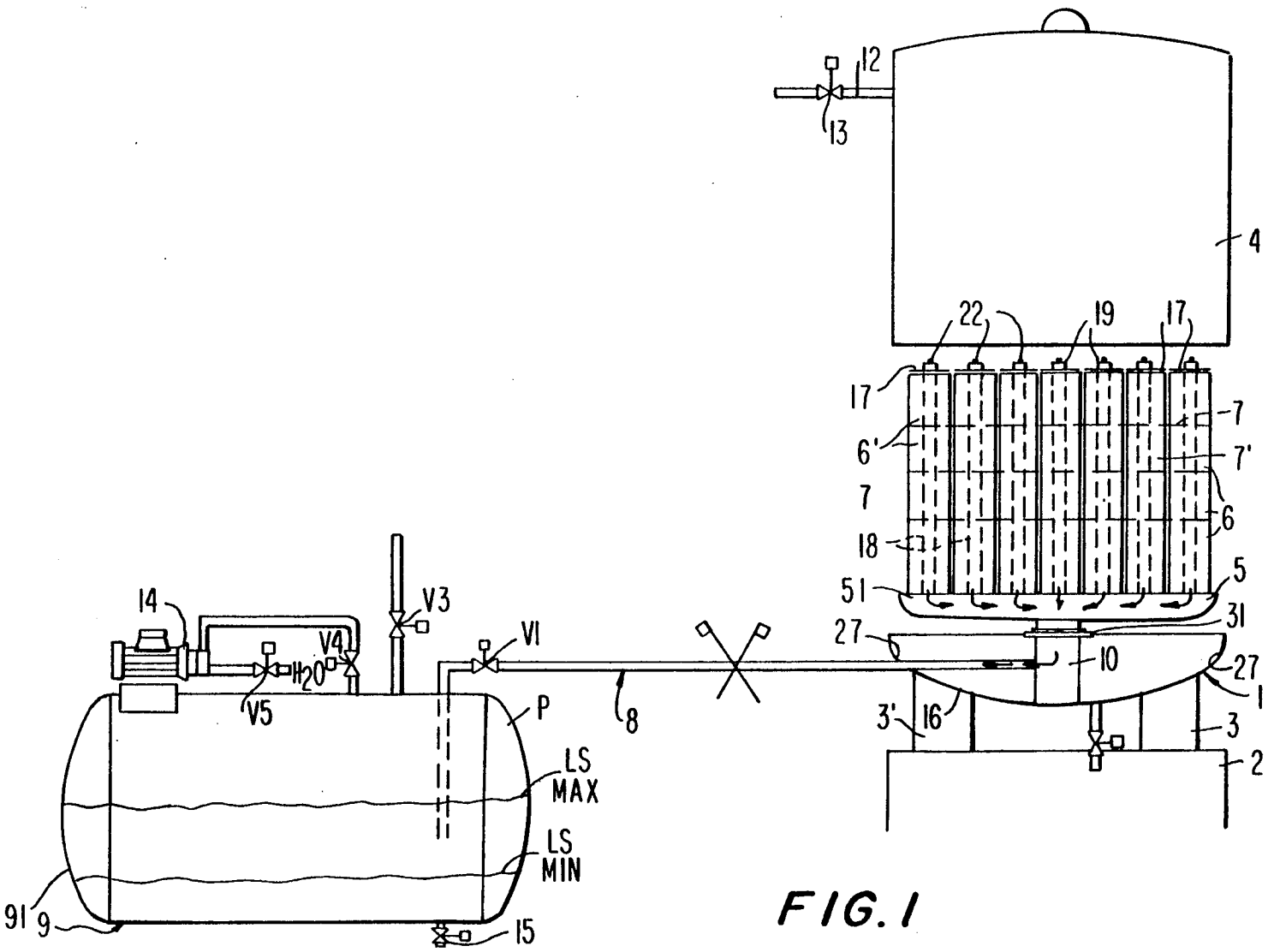
FIG. 1 is a schematic side view of a dyed yarn draining apparatus according to the invention in the opened state.
Figure 2:
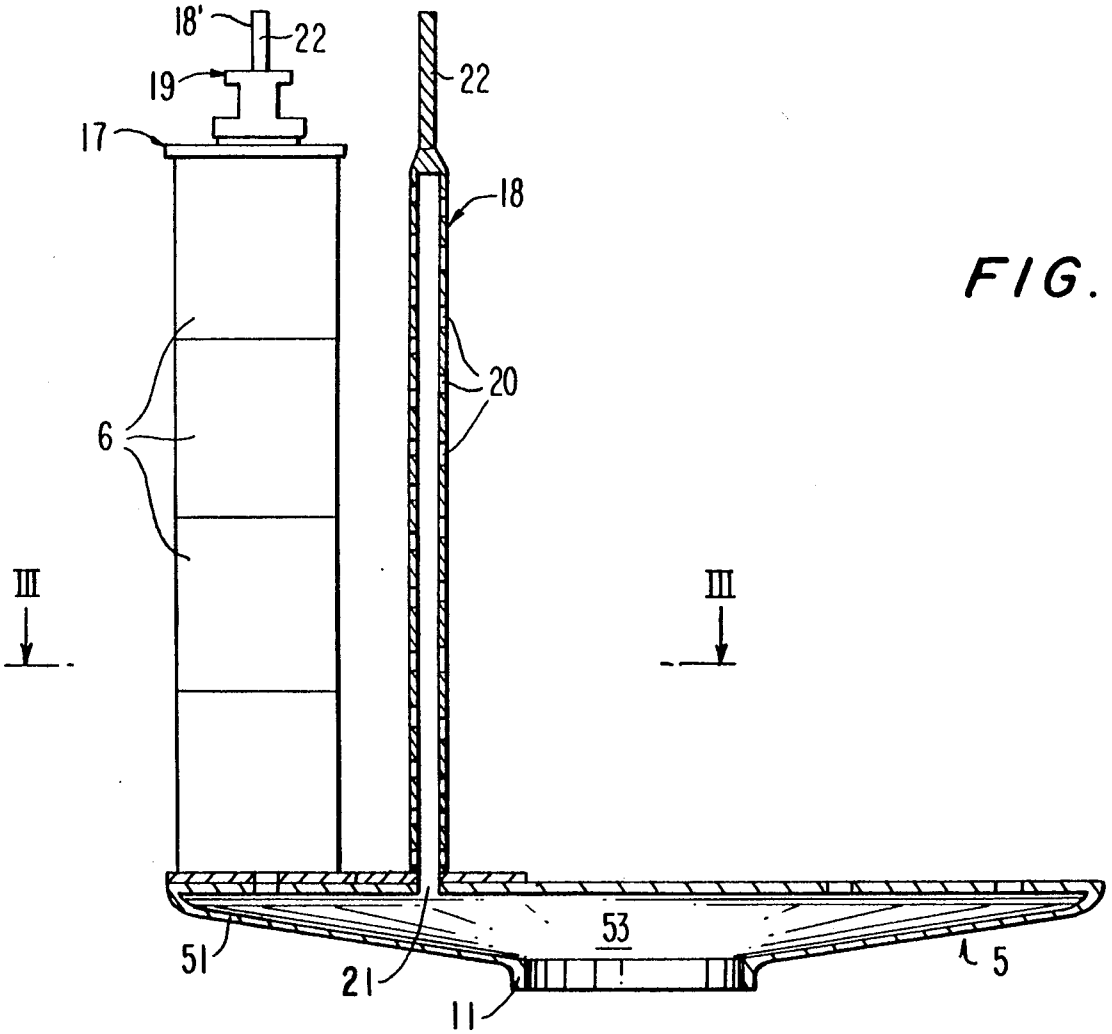
FIG. 2 is a detailed side, partially cross-sectional, view of a dye carrier insert from the apparatus shown in FIG. 1.
Figure 3:
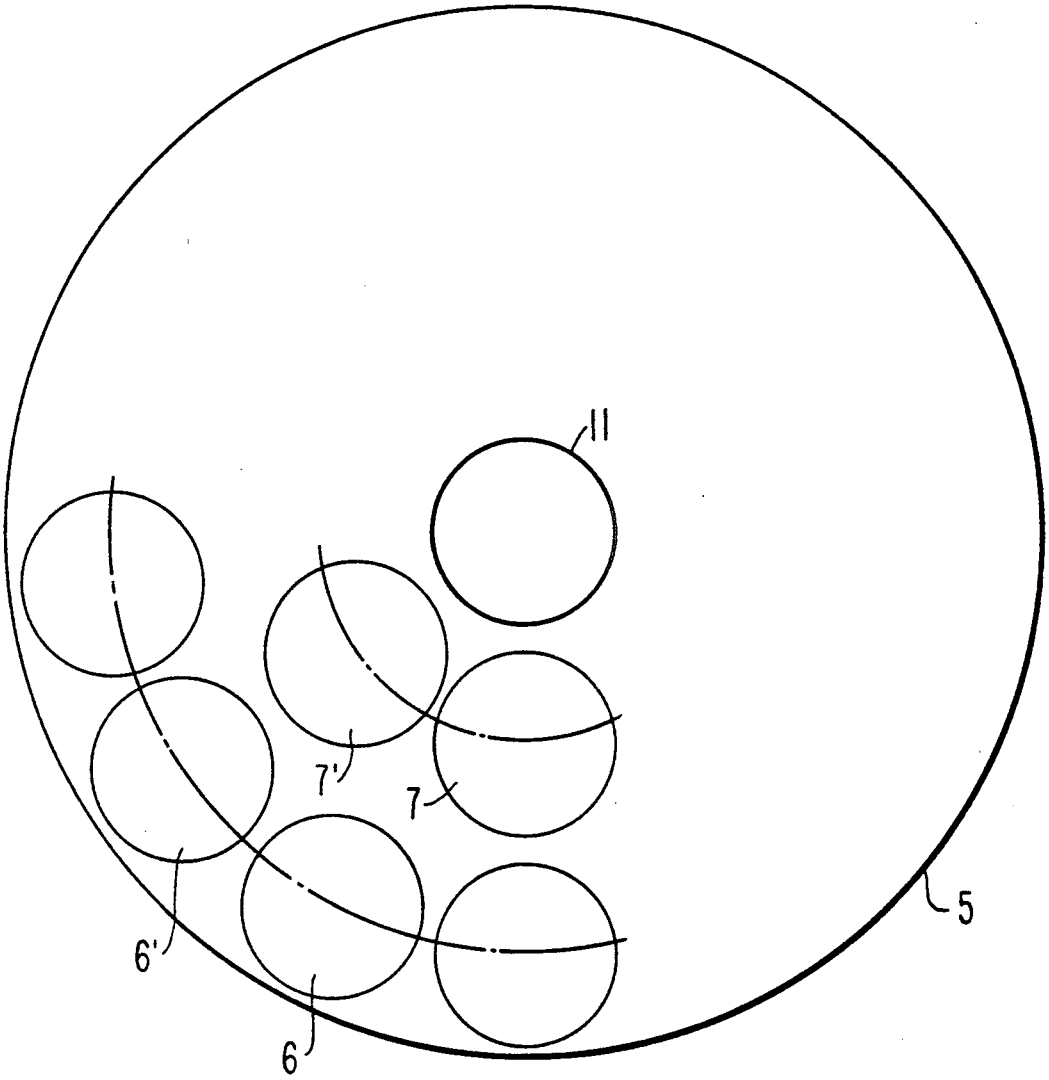
FIG. 3 is a cross-sectional view through the dye carrier insert with the yarn bobbins as shown in FIG. 2.

FIGS. 1 to 3 show a yarn drying apparatus for draining yarn carried on outer yarn bobbins 6,6' and on inner yarn bobbins 7,7' mounted on a dye carrier insert 5. The apparatus for draining yarn comprises a vacuum producing means 14 connected to vacuum tank means 9 so as to be able to produce a vacuum in a vacuum tank 91, the dye carrier insert 5 on which the yarn bobbins 6,6',7,7' with the yarn to be dried are mounted, a coupling means 1 for releasably connecting the dye carrier insert 5 with the vacuum tank means 9 and a bell 4 which is releasably mountable on the coupling means 1 to enclose the dye carrier insert 5 with the yarn bobbins and which is sealable on the coupling means 1 in a vacuum tight manner and valve means V1 in a connecting pipe 8 which connects the coupling means 1 with the vacuum tank means 9 in a gas-tight or vacuum-tight manner.

As shown in more detail in FIG. 2, the dye carrier insert 5 is hollow, has an interior volume 53 and has a plurality of vertically directed perforated hollow carrier tubes 18 mounted on a hollow base 51 and each having a plurality of throughgoing openings 20. The hollow base 51 has a downwardly extending open central pipe 11. The yarn spools 6 are mounted one above the other on outer peripheral carrier tubes 18. The carrier tubes 18 are closed at the top by the threaded rod portions 22 and have a plurality of lateral holes 20 comprising the perforations. The carrier tubes 18 are provided with a bottom opening 21 through which they communicate with the interior of the hollow base 51. A disk-shaped cover 17 is secured to each of the threaded rods 22 and closes the open ends of the topmost yarn bobbin 6,6',7,7' in a gas-tight manner so that air must be drawn through the yarn on the yarn bobbins in operation. The covers 17 are held in place by threaded closing heads 19 which are screwed on the threaded rod portions 22.

The coupling means 1 has a central coupling tube 10 releasably connected to the central pipe 11 of the carrier insert 5 via a pipe coupler 31 in a leak tight manner. The pipe coupler 31 can be any of a number of conventional pipe couplers used for making vacuum-tight connections of pipe sections. The vertical coupling tube 10 continues as an interior pipe, which is connected to the vacuum tank 91 via the connecting pipe 8 with valve means V1 so that the interior 53 of the dye carrier insert 5 communicates with the vacuum tank means 9. The coupling means 1 has a trough 16 for collection of water which drips from the yarn bobbins, 6,7,6',7'. The trough 16 has a inner circumferential bearing surface 27 on which the lower edge of the bell 4 sits. This bearing surface can be provided, for example, with a rubber sealing ring for making a gas-tight seal at the edge of the bell 4.

The vacuum tank means 9 includes a vacuum tank 91 and all devices for automatically measuring and generating the required vacuum. The means for producing the vacuum 14 can be a conventional vacuum pump. The vacuum tank 91 is provided with a drain line 15 with additional valve means for draining water that collects in the vacuum tank. The vacuum tank means 9 can be structured to operate fully automatically. The vacuum pump can have means for automatic switch on and switch off according to the water level in the vacuum tank, which is maintained between the water levels LS max and LS min in operation.

The bell 4 is provided with an inlet connector means 12,13 for connection of its interior with the outside atmosphere. The inlet means 12,13 includes another valve means 13 and a connector pipe 12. The inlet means 12, 13 is opened prior to removal of the bell 4 at the conclusion of drying so that the interior of the bell reaches atmospheric pressure after drying the yarn on the yarn bobbins. The coupling device is advantageously securely anchored to a base 2 via the supports 3,3'.

In operation, the dye carrier insert 5, as a whole with the yarn bobbins on it, is placed on the coupling device 1 from a dye container. The valve V1 is closed so that air and moisture are not drawn into the tank during the mounting operation. The vacuum pump 14 is activated so that a vacuum of approximately 700 mbar. is produced in the vacuum tank 91.

After coupling the central connecting tube 10 of the coupling device 1 with the pipe 11 of the dye carrier insert 5 the valve V1 is opened to begin the draining of the yarn. The control of the valve means for the vacuum tank means 9 is effected in a manner which is known in itself. Thus, since the yarn bobbins 6 are mounted on all the carrier tubes 18 as shown for one carrier tube 18' in FIG. 2, air and moisture, if present, is drawn through the yarn into the lateral holes 20 and through the carrier tubes 18 into the interior of the hollow base 51 of the carrier insert 5 and out through the central pipe 11 and into vacuum tank.

After the draining has been concluded, further processing of the drained yarn on the bobbins can continue. A mixture for treating the yarn can be admitted via the inlet means 12,13 when the additional valve 13 is opened. The mixture is then drawn through the yarn on the yarn bobbins and the residue is drawn into the vacuum tank by suction together with an air mixture. This processing step can also be controlled automatically by the vacuum tank means 9.

The results of suction tests of the apparatus of the invention are given in Table I hereinbelow. Test 1 and test 2 shown in the Table I were conducted using polyester yarn while tests 3 and 4 were conducted using polyamide yarn. The results show that the residual moisture is less than 11% with polyester depending on the titer, within 20 minutes of the commencement of suction. No redrying with heat is required and no draining by centrifugation is used.

TABLE I

SUCTION TEST RESULTS OF THE DRAINING APPARATUS OF THE INVENTION

| No. | raw white | dyed, before suction | after 2 min. suction | after 5 min. suction | after 10 min. suction | after 20 min. suction | after 40 min. suction |
|---|---|---|---|---|---|---|---|
| 1 | | | | | | | |
| weight gr. | 3725 | 8611 | 4751 | 4425 | 4255 | 4133 | 4036 |
| residual moisture % | 0.0 | 131.2 | 27.5 | 18.8 | 14.2 | 10.9 | 8.3 |

TABLE I-continued

| SUCTION TEST RESULTS OF THE DRAINING APPARATUS OF THE INVENTION | | | | | | | |
|---|---|---|---|---|---|---|---|
| No. | raw white | dyed, before suction | after 2 min. suction | after 5 min. suction | after 10 min. suction | after 20 min. suction | after 40 min. suction |
| 2 | | | | | | | |
| weight gr. | 3736 | 8613 | 4760 | 4425 | 4255 | 4130 | 4030 |
| residual moisture % | 0.0 | 130.5 | 27.4 | 18.4 | 13.9 | 10.5 | 7.9 |
| 3 | | | | | | | |
| weight gr. | 3826 | 7831 | 5318 | 4848 | 4655 | 4517 | 4416 |
| residual moisture % | 0.0 | 104.7 | 39.0 | 26.7 | 21.7 | 18.0 | 15.4 |
| 4 | | | | | | | |
| weight gr. | 3830 | 7480 | 5286 | 4854 | 4669 | 4535 | 4440 |
| residual moisture % | 0.0 | 95.3 | 38.0 | 26.7 | 21.9 | 18.4 | 15.9 |
| vacuum bar | | | 0.70–0.53 | 0.51 | 0.49 | 0.48 | 0.48 |

The power requirements for draining spool-dyed yarn by the conventional prior art apparatus and the apparatus of the invention are shown in Table II as follows:

Table II Comparison of Power Requirements for the Apparatus of the Invention and the Prior Art Apparatus

TABLE II

| Comparison of Power Requirements for the Apparatus of the Invention and the Prior Art Apparatus | | | |
|---|---|---|---|
| | Apparatus of the Invention | Centrifuge | Pressure drier |
| Installed Power KW | 9 | 16 | 50–60 |
| Energy Needed per ton of yarn | 5 | 25 | 200 |

Thus the apparatus of the invention has been shown to require only 20% of the energy required for draining the same amount of yarn. This shows an unexpected improvement over the prior art.

While the invention has been illustrated and embodied in a yarn draining apparatus for draining dyed yarn on dye carriers, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims.

1. Apparatus for draining yarn bobbins, said apparatus comprising:

means for producing a vacuum;

a hollow dye carrier insert having an interior volume, a central pipe communicating with said interior volume and means for carrying a plurality of yarn bobbins having yarn to be drained thereon, said means for carrying being connected to the means for producing a vacuum and structured so that, when at least a partial vacuum is produced in said interior volume by said means for producing a vacuum, air is drawn through said yarn on said yarn bobbins into said interior volume;

vacuum tank means connected to the means for producing a vacuum as ballast, said vacuum tank means including a vacuum tank having a capacity not less than the interior volume of the dye carrier insert;

coupling means for receiving the dye carrier insert on which the yarn bobbins are mounted;

a bell releasably mountable on the coupling means to enclose the dye carrier insert carrying the yarn bobbins in a vacuum-tight manner; and valve means connecting the coupling means to the vacuum tank means and operable so as to be able to form said at least partial vacuum in said interior volume of said dye carrier insert for draining the yarn carried on the yarn bobbins, wherein said coupling means comprises a trough for collecting dripping water from said yarn bobbins and a central coupling tube connected with said vacuum tank by a connecting pipe, said valve means being located in said connecting pipe, and a pipe connector releasably connectable to said central pipe of said dye carrier insert and said central coupling tube to provide a gas-tight connection between the central coupling tube and the central pipe.

2. Apparatus as defined in claim 1, further comprising an inlet connection means including additional valve means provided on an upper portion of the bell, said inlet connection means being structured so as to be able to connect an interior of said bell with a surrounding atmosphere and to admit a mixture for treating the yarn on the yarn bobbins.

3. Apparatus as defined in claim 1, wherein said means for carrying of said dye carrier insert comprises a hollow base and a plurality of perforated carrier tubes, each of said carrier tubes being closed at an upper end thereof and connected to said hollow base at a lower end thereof so as to open into said hollow base and communicate with said central coupling tube via said central pipe, said yarn bobbins being mountable on said carrier tubes.

4. Apparatus as defined in claim 3, wherein each of said carrier tubes is closed by a threaded rod and each of said yarn bobbins has an open end closed by a disk-shaped cover, said disk-shaped cover being secured on one of said yarn bobbins by a threaded closing piece engaged on said threaded rod, so that in operation moisture and air is drawn through said yarn and said perforated carrier tubes and into said interior volume when said at least partial vacuum is produced in said interior volume.

* * * * *